United States Patent [19]

Horne

[11] 4,315,370

[45] Feb. 16, 1982

[54] COMBINED SAW CHAIN TENSION ADJUSTER AND SAW CHAIN GUARD

[75] Inventor: David Horne, Staines, England

[73] Assignee: Black & Decker Inc., Newark, Del.

[21] Appl. No.: 168,379

[22] Filed: Jul. 10, 1980

[30] Foreign Application Priority Data

Jul. 13, 1979 [GB] United Kingdom ..... 24517/79

[51] Int. Cl.[3] ..... B27B 17/14

[52] U.S. Cl. ..... 30/386

[58] Field of Search ..... 30/386, 382, 383

[56] References Cited

U.S. PATENT DOCUMENTS

| | | | |
|---|---|---|---|
| 2,718,908 | 9/1955 | Kiekhaefer | 30/386 X |
| 2,767,746 | 10/1956 | Adams | 30/386 |
| 3,267,973 | 8/1966 | Beard | 30/386 |
| 3,636,995 | 1/1972 | Newman | 30/386 |
| 3,866,320 | 2/1975 | Progl | 30/386 |

*Primary Examiner*—Jimmy C. Peters

*Attorney, Agent, or Firm*—Walter Ottesen; Edward D. Murphy; Harold Weinstein

[57] ABSTRACT

A chain saw is provided with a compact lever system which has the dual functions of tensioning the cutting chain and of protecting the operator from a broken chain.

4 Claims, 4 Drawing Figures

COMBINED SAW CHAIN TENSION ADJUSTER AND SAW CHAIN GUARD

RELATED APPLICATIONS

This application is not patentably related to any copending application in the United States. It is related to the foreign application on which priority is based and claimed in the declaration.

SUMMARY

In the operation of a chain saw it is important that the chain tension be properly adjusted, as either insufficient or excess tension will greatly shorten the life of the chain. The chain tension changes during use of the chain saw, because the link pivots wear and the chain lengthens. The chain tension adjustment of a saw should therefore be simple to use, so that adjustment will not tend to be delayed by an operator who is reluctant to take up the task.

It is an object of the present invention to provide a saw chain tension adjuster which is of simple and inexpensive construction, and which is simple to use.

During the operation of a chain saw, the chain will occasionally break, and the broken end of the chain may whip around, after it leaves the cut, endangering the operator. Accordingly, it is common to provide housings of such shape as to tend to guard the operator against a broken chain.

It is a further object of the invention to provide the saw chain tension adjuster with a manually actuated lever, wherein the finger piece is so configured as to make it easy for the operator to provide the required amount of pull needed to tension the chain, and wherein the finger piece is so located as to normally clear the moving chain, but to stop it should it break, and wherein the location of the finger piece is such that the amount of broken chain which can whip around towards the operator is minimized.

THE DRAWINGS

In FIG. 3 the chain is shown broken.

DETAILED DESCRIPTION

Figure 1:
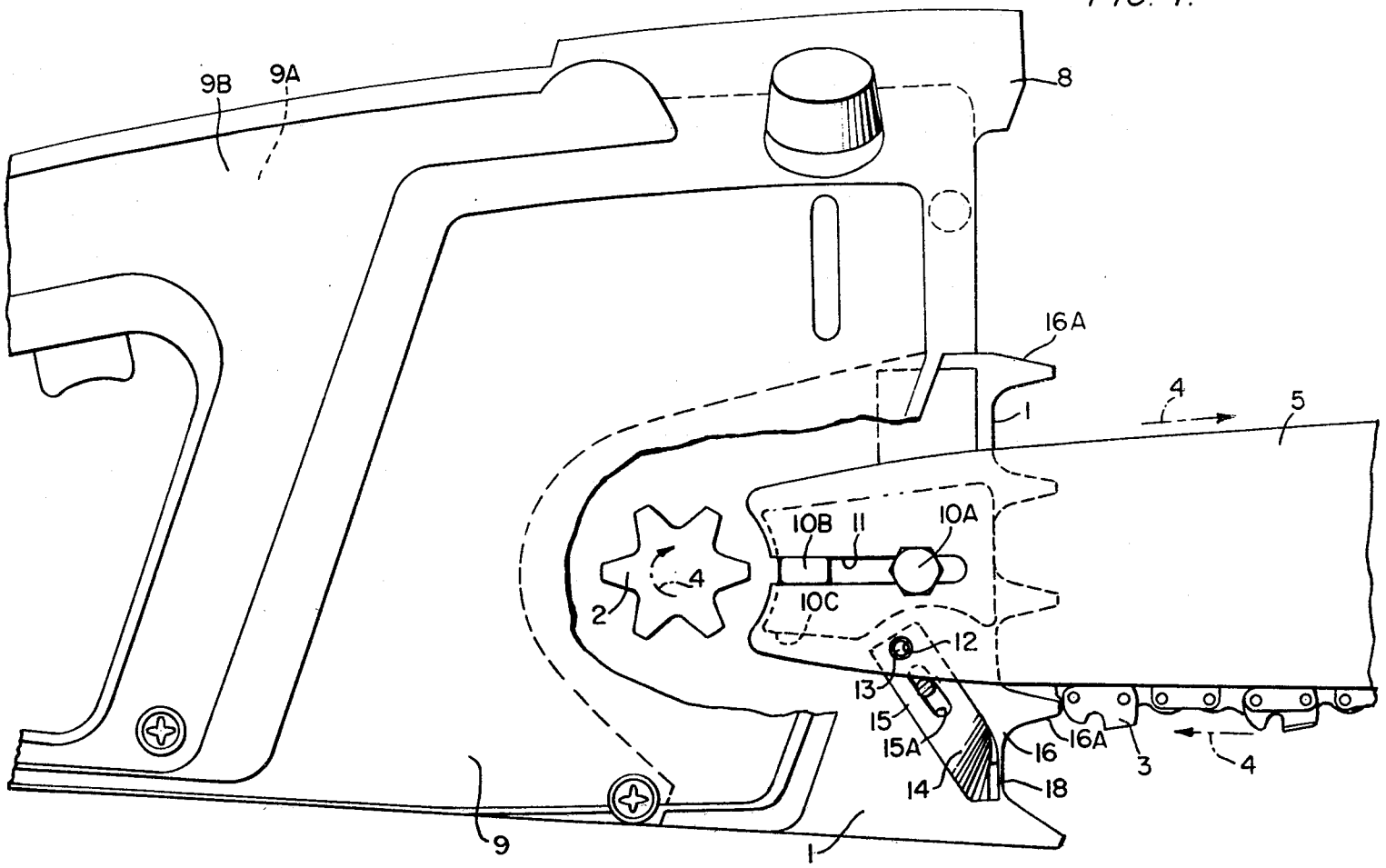
FIG. 1 is a side view of a portion of the chain saw.

FIG. 1 shows part only of the body of a chain saw. The part shown includes a spiked body casting 1, in which is journaled a driving sprocket 2. An endless saw chain, part of which is shown at 3, is driven by sprocket 2 to rotate clockwise around cutter bar 5 in the direction shown by arrows 4.

The sprocket 2 is driven by an electric motor located in motor housing 6 (FIG. 2) by means of a gear reduction train, not shown.

Extending from the spiked body casting 1 above motor housing 6 is a fore-handle 7 (FIG. 2) and a safety guard 8. Extending from the rear of the motor field case is an after-handle 9A (FIG. 1). A cover plate 9 joins the motor field case 6 in such manner that the spiked body casting 1 is between the motor field case 6 and the cover plate 9. The cover plate 9 is shown partly broken away in FIG. 1. The cover plate 9 has an after-handle portion 9B which fairs-in with after-handle 9A.

The cutter bar 5 is located with respect to and is secured to the spiked body casting 1 by means of a cap screw 10A which passes through a slot 11 in the cutter bar. The cutter bar 5 is also located, with respect to the spiked body, by means of a rectangular guide in the form of a projecting tenon or key 10B. The cap screw 10A and tenon 10B jointly locate and clamp the flat cutter bar 5 securely against the flat machined raised surface 10C on the spiked body casting 1.

The cutter bar 5 has an aperture 12 which receives a pin 13 formed on lever 14. Lever 14 is pivoted on fulcrum pin 15 and is actuated by a laterally projecting finger piece 18. As seen from the viewpoint of FIG. 1, the lever 14 lies principally in a plane beyond the plane of cutter bar 5, while the pin 13 extends nearer into the plane of the cutter bar 5 and the finger piece 18 extends considerably still nearer.

It will be noted that the raised surface 10C is recessed to provide a clearance for pin 13 and lever 14, to permit lever 14 to pivot. Since the cutter bar can move only rectilinearly, in order to permit the lever 14 to pivot freely on fulcrum pin 15, that pin is received in a slot shaped aperture 15A in lever 14.

Figure 2:
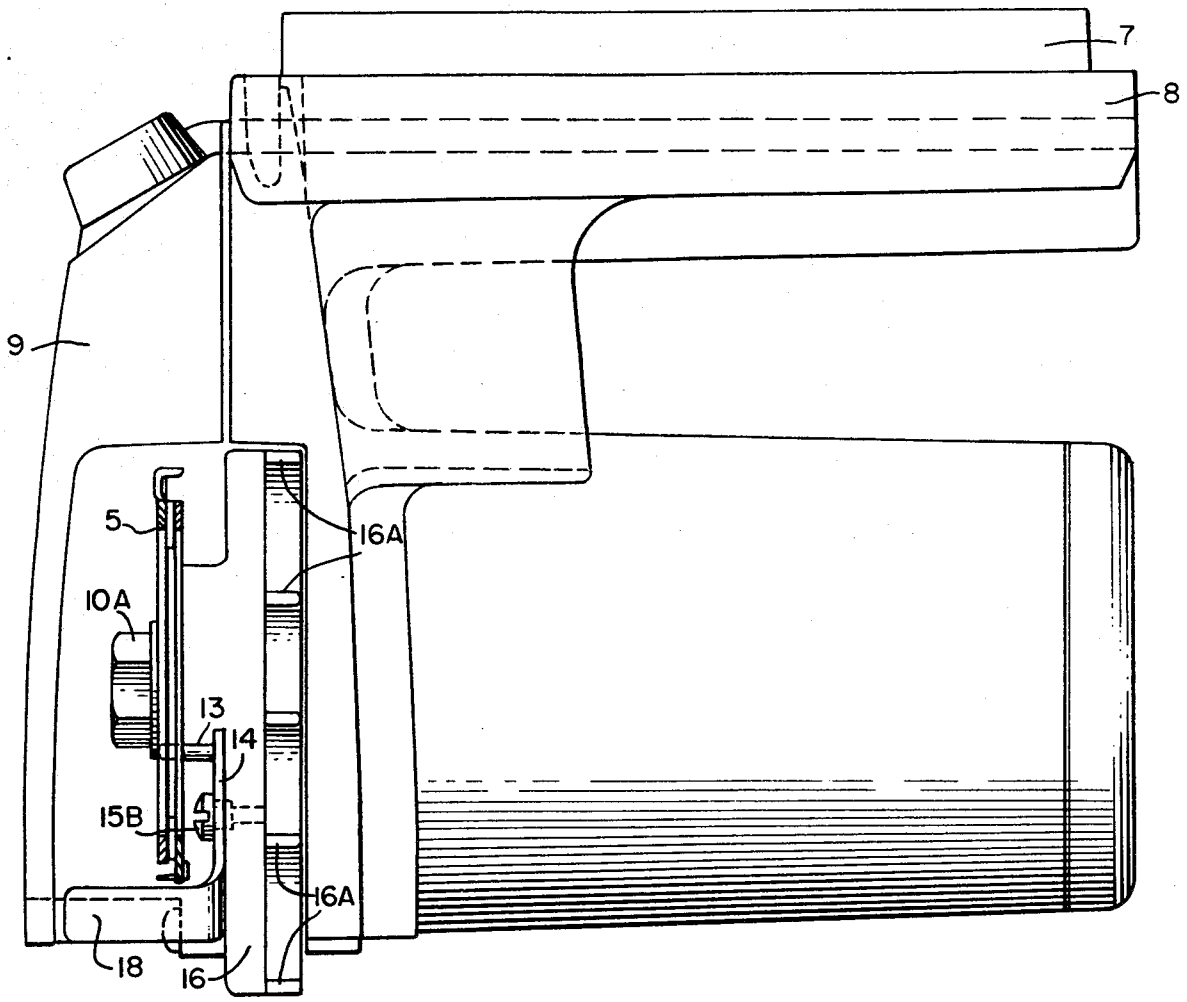
FIG. 2 is an end view of the chain saw, taken from the right end of FIG. 1.

In the actual construction, the fulcrum pin 15 is a shouldered screw, the head of which retains the lever 14 in place against the flat surface of spiked body casting 1 with sufficient looseness to permit the lever 14 to rotate when needed. The head 15B is not shown in FIG. 1 so as not to confuse, but is shown in FIG. 2.

Pivotal movement of the lever 14 is possible only when the bolt 10A has been loosened, at which time the pivotal movement of the lever results in longitudinal movement of the cutter bar 5 towards or away from the sprocket 2, depending upon the direction of movement of the lever 14. It will be understood that movement of the cutter bar 5 in a direction away from the sprocket 2 tensions the saw chain which passes around the sprocket 2 and around another sprocket or guideway, not shown, at the right end of the cutter bar 5.

In use, an operator wishing to increase the saw chain tension loosens the bolt 10A sufficiently to allow the cutter bar 5 to slide on the tenon 10B. The lever 14 is then moved in a clockwise direction by pressing on the finger piece 18 until the required tension is achieved. The bolt 10A is then tightened to secure the cutter bar in its new position.

Thus, movement of the lever 14 can be affected without a tool, and the only tool needed for adjustment is the common socket or box end wrench for cap screw 11A, to unclamp and clamp the cutter bar 5.

The finger piece 18 also acts as a safety surface in the event of breakage of the saw chain while the saw is in use. A saw chain most commonly breaks while cutting a heavy log and the break will usually occur in the region of increasing chain tension, somewhere between where the chain enters the log and where it leaves the log, and more likely closer to the latter place. When this occurs, there may be a significant length of chain moving aft through the air between the end of the cut and the spikes 16A. This can occur because of the diverse irregularities in the shape of logs, which will sometimes have a local hollow region in an otherwise convex surface. The length of chain, moving aft through the air under the pull of the sprocket 2, has a tendency to whip around as the chain is wound in by the sprocket and the length between the sprocket and the broken end decreases. This occurs because any initial sideways motion of the chain is amplified as the scope is shortened. A familiar example is the way a strand of spagetti whips around as it is sucked into the mouth. The operator of the saw could be injured by the portion of the chain that whips back.

By locating the lever 14 well forward of the body portion 1, the whipping length of cutter chain is forced to pivot about the projecting end of the lever and the finger piece 18 and this results in a significant shortening of the length of saw chain that continues towards the user. Such shortening is frequently sufficient to protect the user from injury.

It will be noted that the finger piece 18 is approximately in the same plane as the front surface 16 of the spiked body casting 1. Thus, the finger piece 18 will not obstruct any normal operations, but will be far enough advanced to catch a broken chain.

Figure 3:
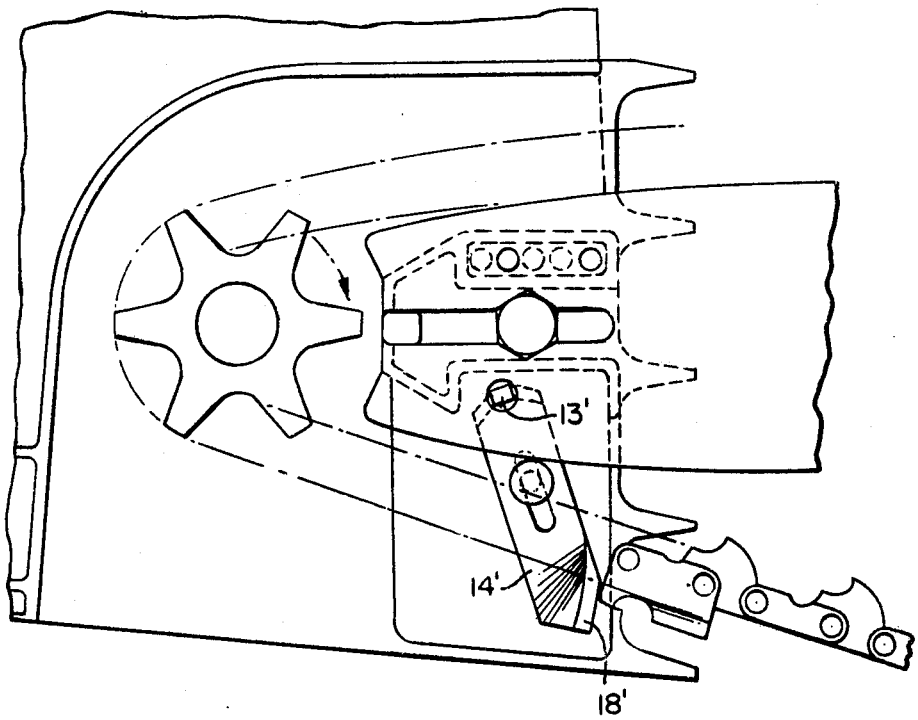
FIG. 3 is a side view of a slight modification of the chain saw of FIG. 1.
Figure 4:
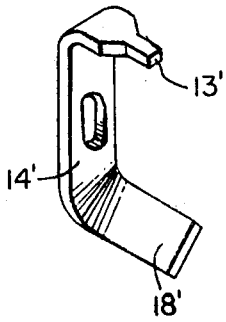
FIG. 4 is a perspective view of the adjusting lever.

FIG. 3 illustrates a slightly modified embodiment of the invention. In this embodiment the lever 14 has been replaced by lever 14', which is illustrated in perspective in FIG. 4. It will be noted that the finger piece 18 has not been altered, but the pin 13, which is round, has been replaced by a stamped rectangular pin 13'. The stamped pin is more economical than the round machined pin, yet works well enough to be entirely satisfactory.

FIG. 3 also illustrates how a broken chain will catch on the finger piece 18'.

What is claimed is:

1. A chain saw having:

a chain bar upon which is mounted a cutting chain; and a lever for tensioning the cutting chain;

characterized in that:

the tensioning lever is configured to obstruct the cutting chain in the event of a breakage thereof; thereby substantially shortening the length of the cutting chain thrown back toward the operator.

2. The subject matter of claim 1 characterized in that:

the said lever has a handle portion which extends laterally of and on either side of the plane of the cutting chain; and the said lever is located in close proximity to that portion of the chain lying between the effective cutting portion thereof and the sprocket which drives the chain.

3. In a chain saw having a main body with a cutter bar projecting from the front thereof, an endless saw chain supported and guided by said cutter bar for continuous movement in a fixed loop shaped path along the length of the chain, and motive power means located in the main body having sprocket means to propel said chain along said fixed path, the improvement characterized by:

lever means to adjust the tension of said saw chain, said lever means having a finger piece for manual or digital actuation;

said finger piece being configured and located so that said finger piece:

extends laterally of a first plane defined by said endless saw chain and extends thusly on both sides of said plane;

lies approximately in a second plane which includes said front of said main body, which second plane is perpendicular to said first plane; and is situated closely adjacent to said saw chain on the exterior side of said fixed loop shaped path.

4. The subject matter of claim 3, in which said fixed loop shaped path consists of two generally straight runs connected with each other by two generally U-shaped bends; and said second plane is approximately perpendicular to one of said straight runs.

* * * * *